US007240745B1

(12) United States Patent
Rives

(10) Patent No.: US 7,240,745 B1
(45) Date of Patent: Jul. 10, 2007

(54) DRILL BIT LUBRICATION APPARATUS AND METHOD

(76) Inventor: Allen Kent Rives, 11831 Pebbleton, Houston, TX (US) 77007

( * ) Notice: Subject to any disclaimer, the term of this patent is extended or adjusted under 35 U.S.C. 154(b) by 0 days.

(21) Appl. No.: 11/279,565

(22) Filed: Apr. 12, 2006

(51) Int. Cl.
*E21B 10/22* (2006.01)

(52) U.S. Cl. ..... 175/343; 175/228; 175/348; 175/349; 175/370

(58) Field of Classification Search ..... 175/348–349, 175/228, 371, 343, 370
See application file for complete search history.

(56) References Cited

U.S. PATENT DOCUMENTS 4,096,917 A * 6/1978 Harris ..... 175/228
4,168,755 A * 9/1979 Willis ..... 175/343
4,254,838 A * 3/1981 Barnetche ..... 175/228
5,195,754 A 3/1993 Dietle
6,227,547 B1 5/2001 Dietle et al.
6,892,828 B2 * 5/2005 Rives ..... 175/19

* cited by examiner

*Primary Examiner*—David Bagnell
*Assistant Examiner*—Giovanna M. Collins
(74) *Attorney, Agent, or Firm*—David B. Dickinson; Lundeen & Dickinson, LLP

(57) ABSTRACT

A lubricating nutating single cone drill bit 10 is disclosed. Bit 10 includes a bit shank 12 with an axially skewed bore 18 rotatably retaining a cutter body 22. A plurality of cutter elements (46, 48) are affixed to the cutter body 22. Bearings (26, 28, 30, 32) enable rotation of the cutter body 22 and lubricant is dispensed to the bearings from a lubricant chamber (76, 76') by a plunger 80 driven by drilling fluid. A method to drill includes attaching the bit 10 to a drill string, engaging the bit 10 into a formation (WB), pumping a drilling fluid into a plunger 80 in the lubricant chamber 76 to dispense lubricant to the bearings (26, 28, 30, 32). The method can include pumping the drilling fluid through a fluid passage 90 in the bit 10 and out of a low pressure orifice 94 on the cutter body 22.

15 Claims, 2 Drawing Sheets

DRILL BIT LUBRICATION APPARATUS AND METHOD

BACKGROUND

The present invention generally relates to drill bits for boring subterranean and sub sea formations. More particularly, the present invention relates to a lubricating nutating single cone drill bit having an axis of rotation skewed relative to the central axis of the bit body in the borehole providing low torque and allowing high compressive loading on the bit assembly.

A number of single cone drill bits have been proposed through the years to drill bore holes for mining, oil and gas exploration, and utility construction. It has been previously recognized that a single cone bit would offer superior design characteristics, such as bearing size permitting greater longitudinal compressive loading on the drill bit. Previous single cone drill bits however provided substantial scraping of the cutter elements causing abnormal wear and torque on the drill string assembly.

Each of the prior single cone drill bits were subject to excessive wearing of the cutting elements because at least during some portion of the rotation, the cutter elements were dragged by the circular motion of the bit on the journal across the formation face rather than moved in compressive engagement with the surface. These cutter elements are designed to have long use lives if used in compression, but have a tendency to break if subjected to side shear or scraping. A nutating single cone drill bit, for example the one disclosed in U.S. Pat. No. 6,892,828, incorporated by reference herein, can offer the advantage of long wearing cutter elements. Typically, traditional tri-cone bits must be repeatedly tripped out of the borehole due to excessively worn cutter elements. Since a nutating single cone drill bit allows for longer service life, the extended periods of down-hole use can be limited by the amount of available lubrication sufficient to maintain the bearings of the nutating single cone bit. Without sufficient lubrication, the bearing can fail prior to the cutter elements of the bit wearing, limiting the usefulness of the nutating single cone drill bit.

SUMMARY OF THE INVENTION

The present invention is directed to a lubrication system for a nutating single cone drill bit. By employing at least one lubricant chamber in the bit shank, drilling fluid can drive a plunger in the chamber and thus dispense lubricant into the rotationally contacting bearing surfaces, for example, of a thrust, radial, or ball bearing. Further, a radial dynamic seal restricts contaminants from contacting the bearing surfaces and extends the life of the bearing to at least the useful life of the cutter or crushing elements on the drill bit body, thereby eliminating the need to trip the drill bit into and out of the well bore to replace lubrication in a bit whose cutter or crushing elements are not worn sufficiently to be removed from service.

In one embodiment, a lubricating nutating single cone drill bit can include a bit shank having a drill string connection on a proximal end and an axially skewed bore formed in a distal end thereof, a plurality of bearings rotatably retaining a cutter body in the axially skewed bore, the cutter body having a plurality of cutter elements on a distal end, and at least one lubricant chamber in the bit shank in communication with a first fluid port in the proximal end of the bit shank and containing a plunger displaceable by a drilling fluid to dispense a lubricant to the plurality of bearings. The bit can include a low pressure orifice on the distal end of the cutter body in communication with a fluid passage extending through the cutter body and the bit shank, the fluid passage in communication with a second fluid port in the proximal end of the bit shank adjacent the first fluid port. The cutter body can have a narrow journal portion at a proximal end and a thrust shoulder between the narrow journal portion and the distal end.

The plurality of bearings retaining the cutter body in the axially skewed bore can include any of the following bearings: 1) a first radial bearing disposed circumferential the narrow journal portion of the cutter body, 2) a second radial bearing disposed circumferentially about the distal end of the cutter body, 3) a thrust bearing disposed between the thrust shoulder of the cutter body and a respective thrust shoulder in the axially skewed bore of the bit shank, and 4) at least one ball bearing disposed between a first channel formed in the axially skewed bore and a second channel formed in the narrow journal portion of the cutter body.

A lubricating nutating single cone drill bit can include a first radial dynamic seal adjacent a distal end of the axially skewed bore between the cutter body and the bit shank and/or a second radial dynamic seal adjacent a proximal end of the axially skewed bore between the cutter body and the bit shank.

In another embodiment, the plurality of cutter elements can be affixed to the cutter body so that a tip of each cutter element is forward an intersection of a central axis of the bit shank and an axis of rotation of the cutter body and a first chordal distance to the tip of each cutter element from the axis of rotation of the cutter body is longer than a second chordal distance to said tip of each cutter element from the central axis of the bit shank.

In yet another embodiment, a lubricating nutating single cone drill bit can include a cutter body rotatably retained in an axially skewed bore of a bit shank by a plurality of bearings disposed between the cutter body and the bit shank, the bit shank having a drill string connection on a proximal end, a plurality of radial dynamic seals disposed in a gap between the axially skewed bore and the cutter body, at least one radial dynamic seal adjacent a proximal end of the cutter body and at least one radial dynamic seal adjacent a distal end of the cutter body to seal the plurality of bearings from contamination, and at least one substantially longitudinal lubricant chamber formed in the bit shank in communication with the gap and in communication with at least one fluid port in the proximal end of the bit shank. The plurality of bearings can include a thrust bearing disposed between a thrust shoulder formed on the cutter body and a respective thrust shoulder in the axially skewed bore of the bit shank. The bit can include a low pressure orifice on the distal end of the cutter body in communication with a fluid passage extending through the cutter body and the bit shank, the fluid passage in communication with a second fluid port in the proximal end of the bit shank.

A nutating single cone drill bit having a cutter body rotatably retained in an axially skewed bore of a bit shank having a connection to a drill string, can include the improvement of a lubricant chamber in the bit shank with a first fluid port to receive a drilling fluid to drive a plunger disposed therein, the lubricant chamber in communication with at least one bearing disposed between the bit shank and the cutter body, a first radial dynamic seal between a distal end of the cutter body and the bit shank, a second radial dynamic seal between a proximal end of the cutter body and the bit shank, and a low pressure orifice on the distal end of the cutter body in communication with a second fluid port in the bit shank formed adjacent the first fluid port through a fluid passage extending through the cutter body and the bit shank. The bit can include a second lubricant chamber and a respective plunger in communication with the bearing surface between the bit shank and the cutter body and in communication with a third fluid port in the bit shank.

In yet another embodiment, a method to drill a formation can include attaching the lubricating nutating single cone drill bit of claim 1 to a drill string to form an assembly, engaging the assembly into the formation, pumping the drilling fluid through the drill string into the first fluid port to drive the plunger and dispense the lubricant to the plurality of bearings, and rotating the drill string to drill the formation with the bit to produce a well bore. The method can include removing the lubricating nutating single cone drill bit from the well bore, and replenishing the lubricant in the at least one lubricant chamber. The step of pumping the drilling fluid can include pumping the drilling fluid through a bit shank fluid passage into a cutter body fluid passage and out a low pressure orifice on the distal end of the cutter body to remove any cuttings from the formation from the well bore.

DETAILED DESCRIPTION

Figure 1:
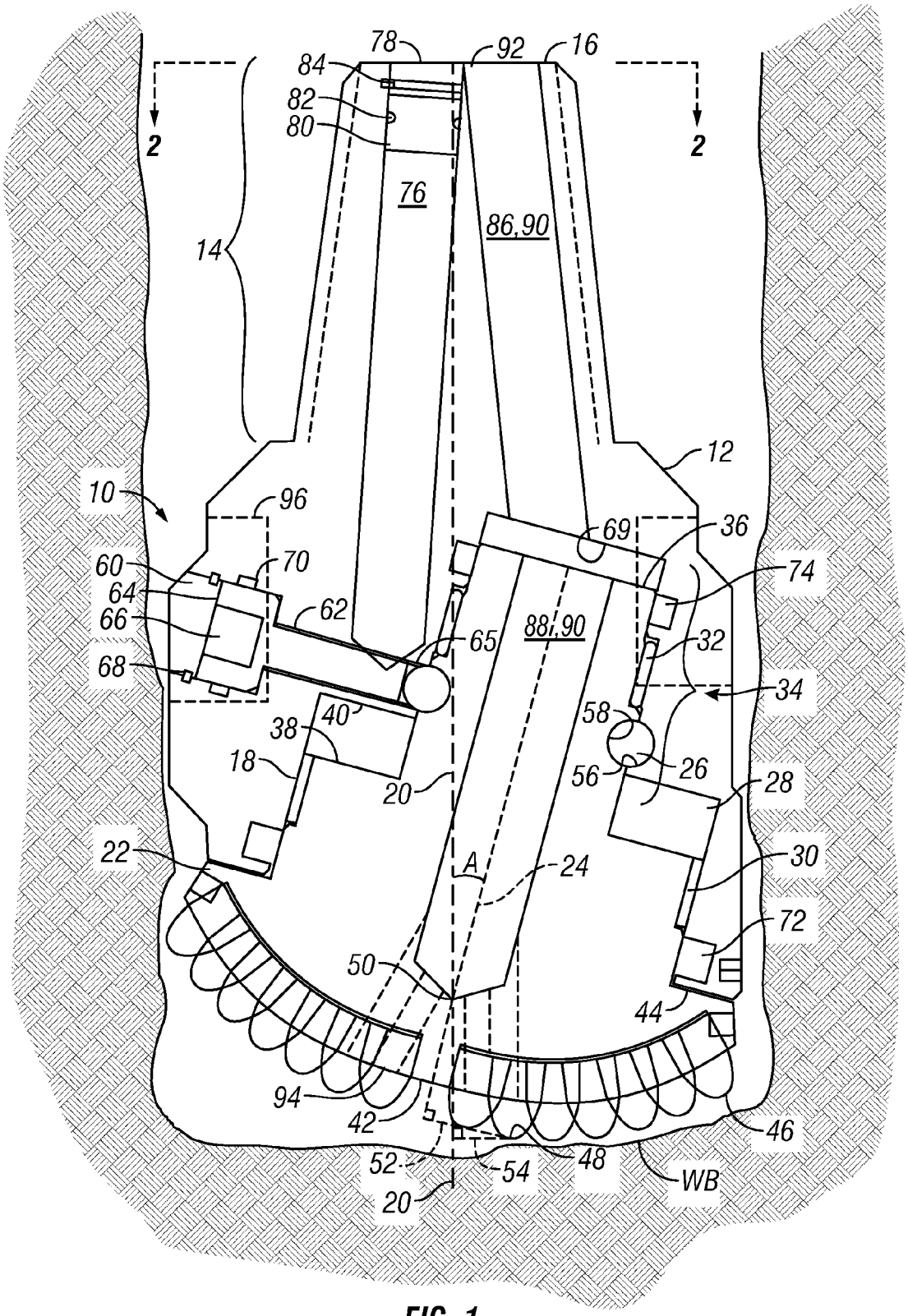
FIG. 1 is a cross-sectional schematic view of a lubricating nutating single cone drill bit, according to one embodiment of the invention.

With reference to the figures wherein like reference numerals are used to refer to like parts, FIG. 1 shows a cross-sectional schematic view of a lubricating nutating single cone drill bit 10. The bit 10 includes a bit shank 12 with a drill string connection 14 adjacent the proximal end 16 and an axially skewed bore 18 formed in a distal end of the bit shank 12. The bore 18 is axially skewed at an acute angle A relative to the axis of the bit shank 12. The axis of rotation 24 of the cutter body 22 can be skewed about 10° from the central axis 20 of the bit shank 12, for example, however any acute skew angle can be utilized, consistent with the disclosure made in U.S. Pat. No. 6,892,828. Cutter body 22 has an outside surface formed respectively to the axially skewed bore 18 to allow at least partial insertion therein. As the cutter body 22 rotates within the axially skewed bore 18, at least one bearing can be disposed therebetween to aid in the rotation. The plurality of bearings in the illustrated embodiment includes ball bearings 26, a thrust bearing 28, and radial bearings (30, 32). The invention is not limited to the illustrated bearings and any type of bearings known to one of ordinary skill in the art of tribology can be used.

The cutter body 22 includes a narrow journal portion 34 at a proximal end 36 and a thrust shoulder 38 formed between the narrow journal portion 34 and the distal end 42. An optional second shoulder 44 is further illustrated to allow cutter element 46, for example, to create a well bore (WB) diameter capable of allowing the bit shank 12 to drill into the formation. A respective bit shank thrust shoulder 40 is formed in the axially skewed bore 18. Thrust bearing 28 is disposed between the cutter body thrust shoulder 38 and the bit shank thrust shoulder 40. Thrust bearing 28 can be selected to support a preferred amount of load on the bit 10. Any of the bearings (28, 30, 32) can be a rubbing bearing or a rolling element bearing, as known to one of ordinary skill in the art. For example, thrust bearing 28 can be a rolling thrust bearing with ball, roller, or needle bearings.

The single cone cutter body 22 includes a plurality of cutter elements (46, 48) on the distal end 24 of the cutter body 22. Preferably, every cutter element (46, 48) is affixed to the cutter body 22 so that a tip of each cutter element, for example, cutter element 48, is forward an intersection 50 of a central axis 20 of the bit shank 12 and an axis of rotation 24 of the cutter body 22. By having each cutter element (46, 48) tip forward a plane defined normal to the axis of rotation 24 of the cutter body 22 at the intersection 50 of the axis of rotation 24 of the cutter body 22 and the central axis 20 of the bit shank 12, the preferred crushing, and not scraping, engagement of the well bore (WB) can be achieved. Similarly, a first chordal distance 52 to the tip of each cutter element (e.g. cutter element 48) from an axis of cutter body rotation 24 can be longer than a second chordal distance 54 to said tip of each cutter element 48 from the central axis 20 of the bit shank 12.

To assemble the lubricating nutating single cone drill bit 10, the thrust bearing 28 and the first 32 and second 30 radial bearings can be disposed between the cutter body 22 and the bit shank 12. The thrust bearing 28, the first radial bearing 32, and/or second radial bearing 30 can be disposed on the cutter body 22 or in the axially skewed bore 18 before assembly. With the thrust bearing 28 and the first 32 and second 30 radial bearings disposed therebetween, the cutter body 22 is inserted into the axially skewed bore 18 of the bit shank 12. The void between the proximal end 36 of cutter body 22 and the proximal end 69 of the axially skewed bore 18 can be any size, and is not limited to that shown. To allow rotation, preferably the cutter body 22 and the axially skewed bore 18 are sized relative to each other to provide a gap therebetween. After the cutter body 22 is inserted into the axially skewed bore 18, the ball bearings 26 can then be added to limit axial movement of the cutter body 22, and thus impede separation of the bit shank 12 and cutter body 22.

The bearing race to house the ball bearings 26 is formed from a first channel 56 circumferentially formed in the narrow journal reception portion of the axially skewed bore 18 and from a second channel 58 circumferentially formed in the narrow journal portion 34 of the cutter body 22. To allow the insertion of ball bearings 26 into the bearing race (56, 58) of the bit 10, a retainer plug port 60 is formed in the lateral surface of the bit shank 12. The retainer plug port 60 includes a narrow portion 62 for receiving a retainer plug 64. Retainer plug 64 can be threadably engaged (not shown) with a respective threaded narrow portion 62 of the retainer plug port 60. Narrow portion 62 is sized to allow ball bearings 26 to be disposed through the retainer plug port 60 into the bearing race (56, 58). Retainer plug 64 can have a socket cap screw with a hexagonal recessed drive 66. Retainer plug 64 can be retained in a threaded or non threaded retainer plug port 60 by a snap ring 68 disposed in a groove formed in the upper portion of the retainer plug port 60. The end of the retainer plug 64 forms a section of the first channel 56 in the axially skewed bore 18 and is preferably retained in a position so as to not interfere with the rolling of the ball bearings 26. A seal 70 of any type is disposed between the retainer plug port 60 and retainer plug 64 to restrict the expulsion of any bearing lubricant.

A plurality of ball bearings 26 can then be added to the bearing race (56, 58) through the retainer plug port 60 and the retainer plug 64 installed to retain the ball bearings 26. The number of ball bearings 26 utilized is design dependent, but is preferably a full-complement.

Lubricant can be added to the bearings (26, 28, 30, 32) at any time before, during, or after assembly. To retain the lubricant, and to restrict the ingress of any contaminants, the invention includes a plurality of seals (72, 74) between the cutter body 22 and the axially skewed bore 18. In a preferred embodiment, the seals (72, 74) are radial dynamic seals. A radial seal is typically designed for an interference fit on the diameters between two concentric, or somewhat eccentric, cylinders, for example. As used herein, the term dynamic seal shall refer to a seal wherein at least one of the sealed surfaces is motive, for example, a rotating shaft. A radial dynamic seal (72, 74) can be any appropriate seal, including, but not limited to, an O-ring, square-ring, U-cup seal, shaft seal, etc.

Radial dynamic seals (72, 74) are typically installed in a groove in a housing (e.g. a groove in the axially skewed bore 18) and compress against a shaft (e.g. the cutter body 22). A first radial dynamic seal 72 is disposed adjacent a distal end of the axially skewed bore 18 between the cutter body 22 and the axially skewed bore 18. A second radial dynamic seal 74 is disposed between the narrow journal portion 34 of the cutter body 22 and the axially skewed bore 18. A radial dynamic seal (72, 74) can be disposed in a groove formed in the cutter body 22 (not shown), a groove in the axially skewed bore 18, or a combination thereof. So arranged, a lubricant disposed in the gap between the cutter body 22 and the axially skewed bore 18 is retained by the radial dynamic seals (72, 74). This configuration protects the bearings (26, 28, 30, 32) from contamination, for example, from drilling fluid and cuttings.

To provide lubrication, the invention includes at least one lubricant chamber 76. The lubricant chamber 76 is a bore formed in the bit shank 12. The proximal end of the lubricant chamber 76 forms a first fluid port 78 in the proximal end 16 of the bit shank 12. The distal end of the lubricant chamber 76 is in communication with the bearings (26, 28, 30, 32) and/or in communication with the gap formed between the cutter body 22 and the axially skewed bore 18 of the bit shank 12 and between the radial dynamic seals (72, 74), said gap providing the clearance to allow rotation of the cutter body 22.

In a preferred embodiment, the distal end of the lubricant chamber 76 is formed so as to be in communication with the retainer plug port 60. This can be achieved by drilling the lubricant chamber 76 at least partially into the retainer plug port 60, or vice versa. As the retainer plug port 60 is in communication with the gap formed between cutter body 22 and the axially skewed bore 18, the lubricant chamber 76 is consequently in communication with the gap, and thus the bearings (26, 28, 30, 32) disposed therein. The portion 65 of the retainer plug port 60 that is not filled with the retainer plug 64 can be bored out (not shown) during the forming of the lubricant chamber 76, to fluidically connect the lubricant chamber 76 and retainer plug port 60, and thus bearings (26, 28, 30, 32). Similarly, the lubricant chamber 76 can be drilled into the retainer plug port 60 at an area where the retainer plug 64 will be disposed (as shown). Any gap between the retainer plug 64 and the retainer plug port 60 can then allow for the lubricant to flow past the retainer plug 64, which has a seal 70, and into the gap formed between the cutter body 22 and the axially skewed bore 18.

After a lubricant has been disposed in the lubricant chamber 76, by any means known in the art, plunger 80 can be disposed in the lubricant chamber 76. Plunger 80 can include a built-in sealing mechanism, or have a radial seal 82 and respective seal grove formed in the plunger 80. To retain the plunger 80 within the lubricant chamber 76, a snap-ring 84 can be disposed in a groove in the proximal end of the lubricant chamber 76. The inner diameter of the snap ring is preferably sized to restrict the passage of the plunger 80. All radial dynamic seals leak. By pressurizing the lubricant in the chamber 76 with substantially the same pressure as the drilling fluid, or more specifically, the pressure inside the drill string at first fluid port 78 imparted by the drilling fluid, there is essentially no pressure differential between the lubricant and environmental side of the radial seal 82 of plunger 80. A lubricant chamber 76 so pressurized will not abruptly discharge the lubricant past the radial dynamic seals (72, 74) when the plunger 80 is acted on by the pressure of a circulating drilling fluid. For example, an unpressurized lubricant chamber 76 can lead to seal blow-out or failure as there is no additional force to counteract the high pressure imparted to the plunger 80, and thus the lubricant, by the drilling fluid. The balancing of the pressure on chamber 76 thereby prevents the ingress of drilling fluid into the bearing surfaces, prolonging bearing life for this single cone nutating drill bit.

Figure 2:
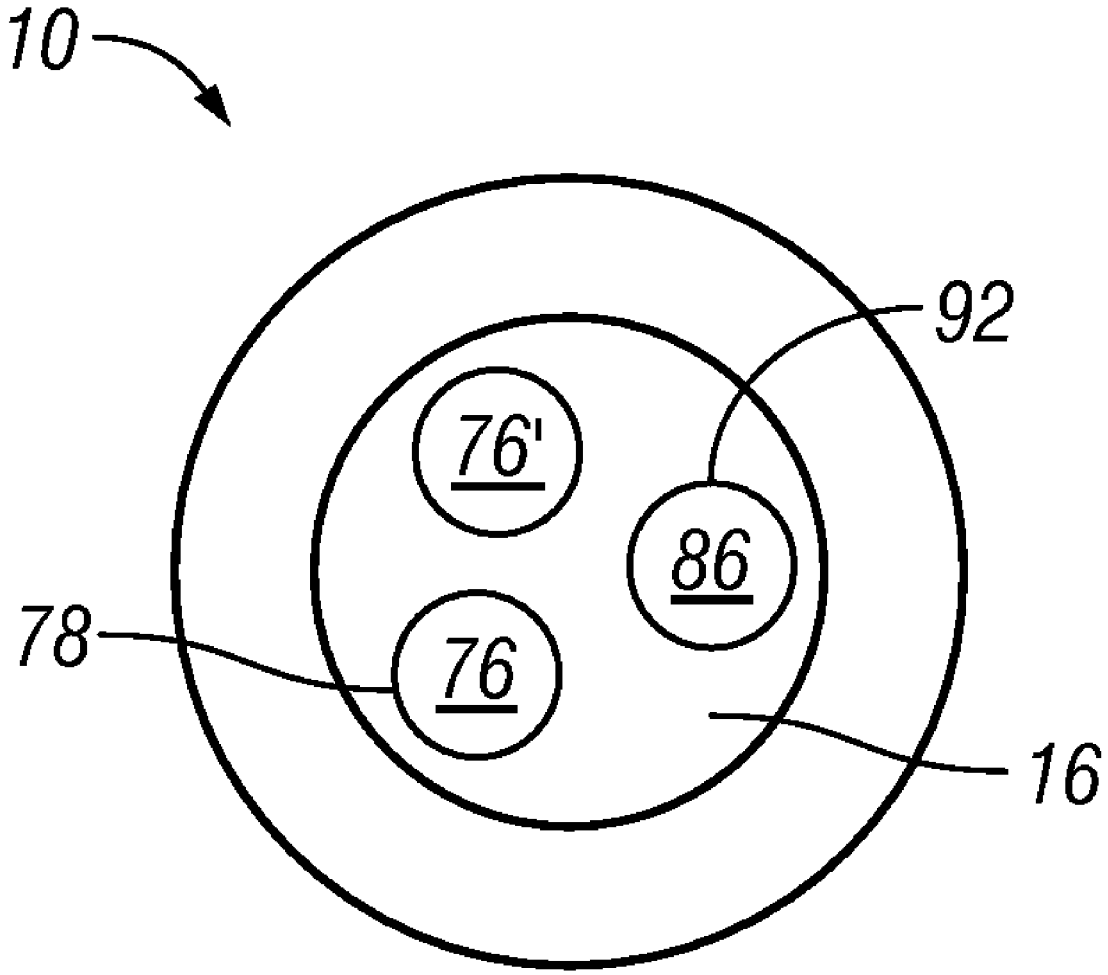
FIG. 2 is a perspective end view of the lubricating nutating single cone drill bit of FIG. 1 as seen along the lines 2-2.

As shown more readily in the view of the proximal end 16 of the bit 10 in FIG. 2, a second lubricant chamber 76' can further be formed in bit shank 12. The second lubricant chamber 76' can be in communication with at least one bearing (26, 28, 30, 32) by a channel formed between a distal end of the second lubricant chamber 76' and a portion of the axially skewed bore 18, for example, a location proximate to a bearing (26, 28, 30, 32) or through a second retainer plug and plug port (not shown) in the manner discussed above. The second lubricant chamber 76' can be in communication with at least one bearing (26, 28, 30, 32) by boring both lubricant chambers (76, 76') at a slightly acute angle so that the distal end of each lubricant chamber (76, 76') is in communication with a single retainer plug port 60, which itself is in communication with the ball bearing race (56, 58).

The nutating single cone drill bit 10 also includes a fluid passage 90 formed therethrough to allow the passage of drilling fluid. The fluid passage 90 including a first section 86 of fluid passage 90 through the bit shank 12 in communication with a fluid port 92 located on the proximal end 16 of bit shank. The first fluid passage section 86 is in communication with a port in proximal end 69 of the axially skewed bore 18. The cutter body 22 has a second section 88 of the fluid passage 90 formed therein. The second fluid passage section 88 is in communication with a port in the proximal end 36 of the cutter body 22. The distal end of the second fluid passage 88 is in communication with at least one low pressure orifice 94 formed on the distal end 42 of the cutter body 22. Any fluid pumped through an attached drill string will thus flow into the fluid port 92, through first fluid passage section 86, into the axially skewed bore 18. As radial dynamic seal 74 forms a fluidic seal between a proximal end 36 of the cutter body 22 and the axially skewed bore 18, the fluid will flow into second fluid passage section 88 and be discharged from at least one low pressure orifice 94 formed in the cutter body 22.

In use, the lubricating nutating single cone drill bit 10 is attached to a drill string at the drill string connection 14 on the proximal end 16 of the bit shank 12. The bit shank 12 can include an optional bit breaker slot 96, shown as a dotted line, formed in the outer surface to permit the engagement and disengagement of a bit 10 and a drill string. The nutating single cone drill bit 10 can then be engaged into a formation, as is known the art. The orientation of the cutter elements (46, 48) and the axially offset geometry of the cutter body 22 with respect to the axis 20 of the bit shank 12 enables a portion of cutter or crushing elements (46, 48) to contact the well bore (WB) while the adjacent section of cutter or crushing elements does not contact the well bore (WB). Such a configuration can minimize or eliminate the dragging of the cutter or crushing elements (46, 48) across the opposing face of the well bore (WB) and thereby reduce the wear experienced by the bit 10 overall. The rolling nutating action of the present bit 10 offers low resistance to the rotational movement of the drill string, and thus provides a much lower operating torque that allows for operation at a higher rotational speed as compared to a typical drill bit. Further, the superior crushing action of the cutter elements (46, 48) abates the need to use a high pressure orifice or jet, as is typical in the art. The present lubricating nutating single cone drill bit 10 offers the benefit of using low pressure orifices 94 in the cutter body 22 and/or operating at a lower pump pressure as the bit 10 does not drill or fluidically abrade the well bore (WB) with typical high pressure jetting, but merely uses the mud fluid flow to cool and lubricate the crushing or cutting action of the nutating bit 10 and carry off cuttings from the face of the wellbore WB. Fluid passage 90 and low pressure orifice 94 can be used to supply a drilling fluid at a lower pressure and/or flow rate to remove the cuttings from the well bore floor and/or cool the bit 10. A high pressure jet can be used if so desired in replacement of low pressure orifice 94.

The nutating single cone drill bit 10 can then be rotated and loaded to drill the formation as is known to one of ordinary skill in the art. The drilling fluid is pumped down the drill string and thus into contact with the proximal surface 16 of the bit shank 12. The drilling fluid can force a plunger 80 into its respective lubricant chamber 76. The speed of displacement of the plunger 80, and thus the lubricant, can depend on many elements, including, but not limited to, the viscosity of the lubricant, the size of the gap between the cutter body 22 and the axially skewed bore 18, the size of the lubricant chamber 76, the spacing and/or number of bearings (26, 28, 30, 32), the number of lubricant chambers (76, 76'), the drilling fluid pressure at the plunger 80, the pressure on the exterior of the bit 10, the pressure of the lubricant in the lubricant chamber (76, 76'), the amount of leakage, if any, allowed by the radial dynamic seal (72, 74), etc. Seepage or leakage at the seals (72, 74), although not required, can aid lubrication by allowing a lubricant to continuously flow to the gap between the cutter body 22 and the axially skewed bore 18, and thus the bearings (26, 28, 30, 32). Independent of any seepage or leakage, by utilizing a lubricant, for example, a viscous grease, and a lubricant chamber (76, 76'), bit 10 can be used for an extended period of time as compared to a bit with no lubricant chamber. The lubricant chamber (76, 76') allows for longer periods of use of a nutating single cone drill bit without repacking lubricant and/or replacing any bearings (26, 28, 30, 32).

While the invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. A lubricating nutating single cone drill bit comprising:

a bit shank having a drill string connection on a proximal end and an axially skewed bore formed in a distal end thereof;

a plurality of bearings rotatably retaining a cutter body in the axially skewed bore, the cutter body having a plurality of cutter elements on a distal end;

at least one lubricant chamber in the bit shank in communication with a first fluid port in the proximal end of the bit shank and containing a plunger displaceable by a drilling fluid to dispense a lubricant to the plurality of bearings; and an orifice on the distal end of the cutter body in communication with a fluid passage extending through the cutter body and the bit shank, the fluid passage in communication with a second fluid port in the proximal end of the bit shank adjacent the first fluid port.

2. The lubricating nutating single cone drill bit of claim 1 wherein the cutter body comprises a narrow journal portion at a proximal end and a thrust shoulder between the narrow journal portion and the distal end.

3. The lubricating nutating single cone drill bit of claim 2 wherein the plurality of bearings retaining the cutter body in the axially skewed bore comprises:

a first radial bearing disposed circumferential the narrow journal portion of the cutter body;

a second radial bearing disposed circumferential the distal end of the cutter body;

a thrust bearing disposed between the thrust shoulder of the cutter body and a respective thrust shoulder in the axially skewed bore of the bit shank; and at least one ball bearing disposed between a first channel formed in the axially skewed bore and a second channel formed in the narrow journal portion of the cutter body.

4. The lubricating nutating single cone drill bit of claim 3 further comprising a radial dynamic seal adjacent a distal end of the axially skewed bore between the cutter body and the bit shank.

5. The lubricating nutating single cone drill bit of claim 4 further comprising a second radial dynamic seal adjacent a proximal end of the axially skewed bore between the cutter body and the bit shank.

6. The lubricating nutating single cone drill bit of claim 1 wherein the plurality of cutter elements are affixed to the cutter body so that a tip of each cutter element is forward an intersection of a central axis of the bit shank and an axis of rotation of the cutter body and a first chordal distance to the tip of each cutter element from the axis of rotation of the cutter body is longer than a second chordal distance to said tip of each cutter element from the central axis of the bit shank.

7. The lubricating nutating single cone drill bit of claim 1 wherein a proximal end of the at least one lubricant chamber forms the first fluid port in the proximal end of the bit shank.

8. A method to drill a formation comprising:

attaching the lubricating nutating single cone drill bit of claim 1 to a drill string to form an assembly;

engaging the assembly into the formation;

pumping the drilling fluid through the drill string into the first fluid port to drive the plunger and dispense the lubricant to the plurality of bearings and into the second fluid port, through the fluid passage and out the orifice to remove any cuttings from the formation from a well bore; and rotating the drill string to drill the formation with the bit to produce the well bore.

9. The method of claim 8 further comprising:

removing the lubricating nutating single cone drill bit from the well bore; and replenishing the lubricant in the at least one lubricant chamber.

10. A nutating single cone drill bit having a cutter body rotatably retained in an axially skewed bore of a bit shank having a connection to a drill string, the improvement comprising:

a lubricant chamber in the bit shank in communication with a first fluid port in a proximal end of the bit shank to receive a drilling fluid to drive a plunger disposed therein, the lubricant chamber in communication with at least one bearing disposed between the bit shank and the cutter body;

a first radial dynamic seal between a distal end of the cutter body and the bit shank;

a second radial dynamic seal between a proximal end of the cutter body and the bit shank; and an orifice on the distal end of the cutter body in communication with a second fluid port in the bit shank formed adjacent the first fluid port through a fluid passage extending through the cutter body and the bit shank.

11. The nutating single cone drill bit of claim 10 further comprising a second lubricant chamber and a respective plunger in communication with the at least one bearing between the bit shank and the cutter body and in communication with a third fluid port in the proximal end of the bit shank.

12. The improvement of claim 10 wherein a proximal end of the lubricant chamber forms the first fluid port in the proximal end of the bit shank.

13. A lubricating nutating single cone drill bit comprising:

a bit shank having a drill string connection on a proximal end and an axially skewed bore formed in a distal end thereof;

at least one ball bearing rotatably retaining a cutter body having a plurality of cutter elements on a distal end thereof in the axially skewed bore, the at least one ball bearing disposed between a first channel formed in the axially skewed bore and a second channel formed in the cutter body;

a retainer plug port extending from a lateral surface of the bit shank into the first channel to allow insertion of the at least one ball bearing, the retainer plug port receiving a retainer plug; and at least one lubricant chamber in the bit shank in communication with the retainer plug port and in communication with a first fluid port in the proximal end of the bit shank, the at least one lubricant chamber containing a plunger displaceable by a drilling fluid to dispense a lubricant to the at least one ball bearing through the retainer plug port.

14. The lubricating nutating single cone drill bit of claim 13 wherein a proximal end of the at least one lubricant chamber forms the first fluid port in the proximal end of the bit shank.

15. The lubricating nutating single cone drill bit of claim 13 further comprising an orifice on the distal end of the cutter body in communication with a fluid passage extending through the cutter body and the bit shank, the fluid passage in communication with a second fluid port in the proximal end of the bit shank adjacent the first fluid port.

* * * * *